United States Patent [19]

Scott et al.

[11] 4,194,544

[45] Mar. 25, 1980

[54] SPLITTING DEVICE

[75] Inventors: Lewis A. Scott, Lake Oswego; Duane M. Gibson, Milwaukie, both of Oreg.

[73] Assignee: Omark Industries, Inc., Portland, Oreg.

[21] Appl. No.: 929,860

[22] Filed: Jul. 31, 1978

[51] Int. Cl.[2] ..... B27L 7/00

[52] U.S. Cl. ..... 144/193 D; 254/104

[58] Field of Search ..... 144/193 R, 193 D, 193 E, 144/193 G, 194; 254/104; 33/392

[56] References Cited

U.S. PATENT DOCUMENTS

| | | | |
|---|---|---|---|
| 374,574 | 12/1887 | Bentley | 254/104 |
| 759,868 | 5/1904 | Eich | 254/104 |
| 953,162 | 3/1910 | Weinberg | 254/104 |
| 1,195,423 | 8/1916 | Waters | 254/104 |
| 1,319,656 | 10/1919 | Merwin | 144/193 D |
| 1,742,573 | 1/1930 | Berg . | |
| 3,670,789 | 6/1972 | Long | 144/193 D |
| 3,993,113 | 11/1976 | Thackery . | |
| 4,091,851 | 5/1978 | Ober | 144/193 R |

FOREIGN PATENT DOCUMENTS

| | | | |
|---|---|---|---|
| 6727 | 3/1932 | Australia | 144/193 G |
| 186391 | 10/1953 | Austria | 144/194 |
| 633270 | 7/1936 | Fed. Rep. of Germany | 144/193 D |
| 944243 | 11/1948 | France | 254/104 |
| 48054 | 7/1961 | Poland | 144/193 D |

*Primary Examiner*—R. L. Spruill
*Assistant Examiner*—W. D. Bray
*Attorney, Agent, or Firm*—Robert L. Harrington

[57] ABSTRACT

An elongated cone like member having a pointed end and a relatively large blunt end with the intermediate portion flaring outwardly from the pointed end to the blunt end, and serrations formed in the member adjacent the pointed end. The pointed end of the member is plunged into the end of a short length log and the blunt end is struck by a driving maul. The serrations prevent the member from bouncing back out of the wood and the multi-directional flaring of the intermediate portion applies splitting pressure radially in a symmetrical pattern from the point as the member is driven into the wood to thereby split the log where it is weakest.

7 Claims, 4 Drawing Figures

SPLITTING DEVICE

HISTORY OF INVENTION

This invention relates to a splitting device and more specifically to a cone like shaped splitting device.

Splitting wood is most commonly associated with converting log lengths into firewood sections. Short log lengths of soft wood can be split most conveniently by a few blows with an ax or splitting maul. As the log lengths increase or as the logs get tougher, it is preferable to employ a splitting device which is commonly referred to as a splitting wedge. The splitting wedge is stuck in the wood and then repeatedly struck with a driving maul to drive the wedge into the log until it splits apart.

The splitting wedge is called that simply because it is wedge shaped, i.e., two planar faces that converge into an edge. The wedge shape is the accepted shape for axes, splitting mauls, and splitting wedges and has been the accepted shape for many, many years. Yet, there are at least two very common problems with the wedge shape. The edge is not normally sharp and thus requires a substantial force to get it started into the wood. To wield a driving maul with one hand while holding the wedge with the other is not easy and is also quite dangerous.

Secondly, the flaring sides of the wedge produces a unidirectional splitting force that is dictated by the placement of the edge of the splitting wedge in the wood. Most logs because of their structure are more easily split along one direction, and of course it is preferred to align the edge of the wedge to produce a corresponding splitting force. However, this log weakness cannot be visually determined for the most part, and the user simply guesses when he places the edge of the splitting wedge. The result is that the user often works harder than necessary to split his logs.

The present invention is believed to obviate the disadvantages of the splitting wedge by providing a splitting tool that is easier to use and more effective in splitting logs. The preferred form is a metal cone with a point at one end that flares outwardly in a symmetrical manner to a driving head. The point is more easily thrust into the log end as compared to the edge of a wedge. The head is struck with a driving maul; and because the splitting force is applied uniformly around the circumference of the tool, the log splits at its weakest point.

Having briefly described the invention, a more complete understanding will be realized with reference to the following detailed description and drawings wherein FIG. 1 illustrates a log being split with a splitting device of the present invention;

Figure 1:
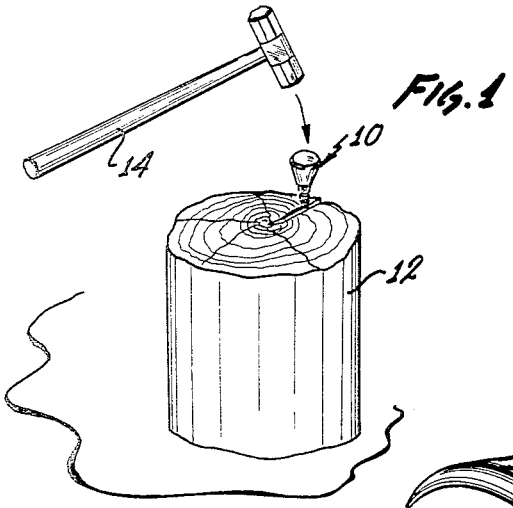

Referring to the drawings, the present invention is intended for splitting firewood as illustrated in FIG. 1. The user initially grips the device 10 like a dagger and thrusts it into the log 12. He then strikes the device 10 with a driving maul 14. As the device is driven, the uniformly multi-directional flared sides force a separation outwardly from the device at the weakest section line in the log. It will be appreciated that the force required to drive the device 10 into the log 12 and the penetration of the device into the log to effect splitting is dependent on the log characteristics. The device will certainly at times be driven all the way into the log and it is therefore desirable that the head portion 18 not interfere with such continued penetration and is thus dimensionally contained within the outer dimension of the flared sides. The material of the device 10 is selected as a material such as metal to withstand the impact of the maul.

Figure 2:
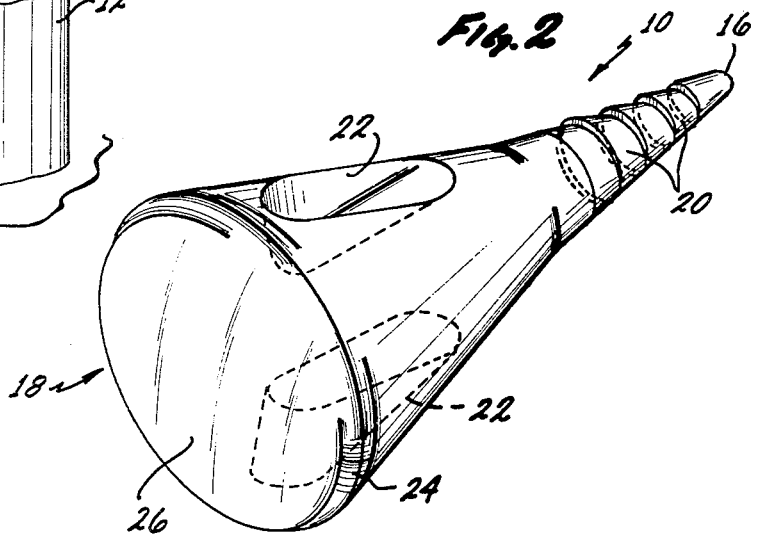
FIG. 2 is a perspective view of the splitting device of FIG. 1.
Figure 3:
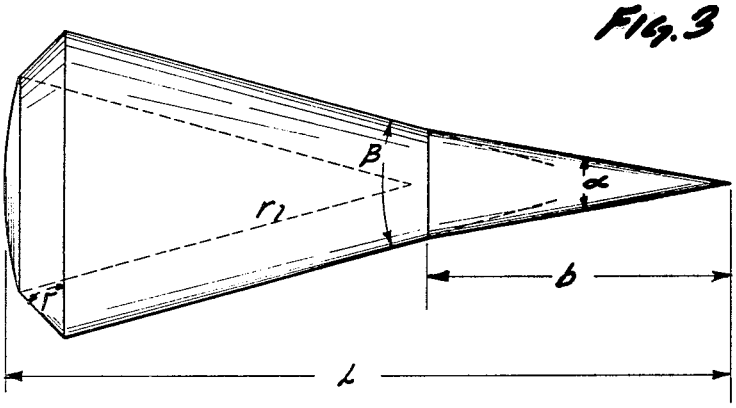
FIG. 3 is a schematically illustrated side view of the splitting device of FIG. 2.

FIGS. 2 and 3 more specifically illustrate the splitting device 10. As shown, the device is an elongate conical like member that flares outwardly from a point 16 to a head portion 18. It will be noted from FIG. 2 that the point 16 is preferably blunted or narrowly rounded for safety in handling the device, for convenience in manufacturing, and to avoid having a sharp point that would be more readily bent or broken. Gripping means such as serrations or teeth like projections 20 are provided adjacent the point 16 to prevent the device 10 from rebounding or bouncing back out of the wood. Relief areas 22 are provided to aid in gripping the device as when thrusting it into the log. The head portion 18 has a chamfered ring area 24 and a slightly convex curved top surface 26 to avoid exposing a flat surface or squared off edges that when struck by the driving maul is more susceptible to chipping.

As viewed in FIG. 3, it will be noted that the portion of the cone nearest the point (the bottom portion) has a more shallow angle of flare than the top section. The bottom portion being less flared aids the startup penetration, whereas the top section upon entering the log more rapidly increases the applied splitting force as the cone is driven. In a specific embodiment the overall length L is 7 inches, whereas the bottom section b is 3 inches (preferably less than half the overall length). The included angle of flare Alpha ($\alpha$) for the bottom section b is 20° (preferably less than 30° ), whereas the angle Beta ($\beta$) for the top section is 30° (preferably less than 45° ). The chamfered ring area angle Gamma ($\gamma$) is 45° and the convex curved top surface has a radius of $3\frac{1}{2}''$ producing a convex surface with a rise no greater than $\frac{1}{8}$ inch.

Figure 4:
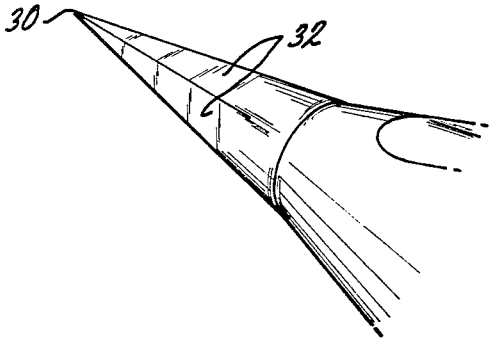
FIG. 4 is an alternate embodiment of the invention.

FIG. 4 illustrates an alternate embodiment of the invention. Whereas a conical shape is preferable, it is believed that the superior results of the splitting cone are achieved by reason of the application of the multi-directed splitting action emanating from a point rather than an edge. This same multi-directional splitting force can be achieved from a shape such as illustrated in FIG. 4 which is conical like in that it flares outwardly in a symmetrical pattern from a point 30 but which has multiple sides 32. Other desirable features such as the convex head portion, two level flaring, and the serrations are similarly applicable to this alternate embodiment. However other modifications might include a combination of a flat sided lower portion with conical upper portion as suggested by the drawing. A still further advantage can be achieved by making the device hollow so as to reduce the weight of the splitting device thus requiring less driving force for propelling the mass of the device through the wood. It should also be understood that numerous other variations and modifications will occur to the artisan having the benefit of this disclosure without departing from the scope of the invention as defined in the following claims.

We claim:

1. A splitting device adapted to be driven by a striking force from a maul for splitting logs comprising: an elongate conical like member produced from a material such as metal and converging to a point which is adapted for startup penetration into a log end, gripping means provided on said member adjacent the point to facilitate holding of the device in the log during startup penetration, said member being symmetrically flared from the point to a head portion, said head portion being dimensionally contained within the outer dimension of the flared member and adapted to receive a striking force from a maul independent of the splitting device for driving the point and following symmetrically flared portion of the member and including the head portion as necessary into the log thereby to produce multi-directed splitting forces to seek out the weakest splitting section line of the log and effect splitting of such log.

2. A splitting device for splitting logs as defined in claim 1 wherein said gripping means comprises serrations located adjacent the point to facilitate holding of the device in the log and thereby prevent the device from bouncing out of the log in reaction to being struck by the maul.

3. A splitting device for splitting lengths of logs as defined in claim 2 where in the conical like member has a bottom portion having an included flare angle less than 30° and an upper portion having an included angle at least 30° and less than 45°.

4. A splitting device for splitting lengths of logs as defined in claim 3 wherein said bottom portion is less than half the total length of the device.

5. A splitting device for splitting lengths of logs as defined in claim 4 wherein the head portion has a convex curved driving top surface.

6. A splitting device as defined in claim 1 wherein the center of the main body portion is hollow so as to reduce the overall weight of the device.

7. A splitting device adapted to be driven by a maul into a log to effect splitting of the log comprising a unitary member having a longitudinal axis and including a lower log penetrating portion, an intermediate portion and a head portion, said lower portion being of conical configuration coaxial with said longitudinal axis and diverging from its point toward said intermediate portion, said point being narrowly rounded, the side walls of said lower section defining an included angle of less than about 30° and having serrations therein adapted to engage the log when said lower portion penetrates the same to inhibit rebound of the device when struck blows with a maul; said intermediate portion being of frustoconical configuration coaxial with said longitudinal axis and diverging from said lower portion toward said head portion, the wall of said intermediate portion defining an included angle of less than about 45°; said head portion defining a slightly convexly curved surface adapted to be struck with a maul progressively to drive first said lower portion and thence said intermediate portion into a log so as to cause said log to split along its weakest splitting line.

* * * * *